United States Patent [19]

Nimylowycz

[11] 4,007,685

[45] Feb. 15, 1977

[54] GAS GENERATOR

[75] Inventor: Osyp Nimylowycz, Philadelphia, Pa.

[73] Assignee: The United States of America as represented by the Secretary of the Army, Washington, D.C.

[22] Filed: July 30, 1975

[21] Appl. No.: 600,349

[52] U.S. Cl. ..... 102/39; 60/225; 102/90; 280/735; 280/741

[51] Int. Cl.[2] ..... F42B 3/04

[58] Field of Search ..... 102/37.6, 37.7, 39, 102/40, 69, 666, 90; 60/225, 250, 254, 256, 39.47, 39.82 E; 337/401, 402, 406, 407, 409, 416; 280/150 AB, 735, 741; 23/281

[56] References Cited

UNITED STATES PATENTS

| | | | |
|---|---|---|---|
| 220,674 | 10/1879 | Smith | 337/401 |
| 643,491 | 2/1900 | Froment | 337/407 |
| 1,132,245 | 3/1915 | Ammons | 337/407 |
| 2,956,401 | 10/1960 | Kane | 60/250 |
| 3,201,549 | 8/1965 | Lowe | 337/401 |
| 3,270,668 | 9/1966 | Silver | 60/256 X |
| 3,573,001 | 3/1971 | Bovard | 102/39 |
| 3,701,256 | 10/1972 | Pelham | 60/254 |
| 3,879,942 | 4/1975 | Dorn et al. | 60/254 |
| 3,888,079 | 6/1975 | Diesinger | 60/250 |

*Primary Examiner*—Harold Tudor
*Attorney, Agent, or Firm*—Nathan Edelberg

[57] ABSTRACT

A multi-stage gas generator in which selective sequential initiation of compartmental propellant charges is available as a pulsing gas generator. The generator has individual gas generating compartments mounted in tandem and separated from each other by a partitioning wall, each wall having an undirectional plug in a filtering passage, an ignition propellant and an associated electric squib with a pyro-electric switch responsive to generated propellant gas in an adjacent compartment.

5 Claims, 3 Drawing Figures

33
31
34
30
32
13
14
13
12
13
44
14
45
50
62
40
1
1
11
46
12
54
53
52
55
51
14
13
31
29
27
26
28
30
25
16
35
24
23
15
18
17
21
22
19
20

34
33
31
30
32
13
14
13
12
14
11
43
41
40
44
45
48
50
40
13
62
12
61
42
53
62
54
31
48
51
46
47
26
30
13
29
55
60
27
28
14
25
35
15
18
17
21
22
19
20

GAS GENERATOR

The invention described herein may be manufactured, used and licensed by or for the Government for governmental purposes without the payment to me of any royalty thereon.

One of the objects of the invention is to provide an inexpensive multi-stage propellant gas generator arrangement having a maximum loading density.

Another object of the invention is to provide such an arrangement having a safe internal electric ignition system.

A further object of the invention is to provide such an arrangement in which adjacent internal compartments have a common partitioning walls initially sealed prior to sequential priming and operation of parallel circuitry.

These and other objects, features and advantages will become more apparent from the following description and accompanying drawings in which.

Figure 1:
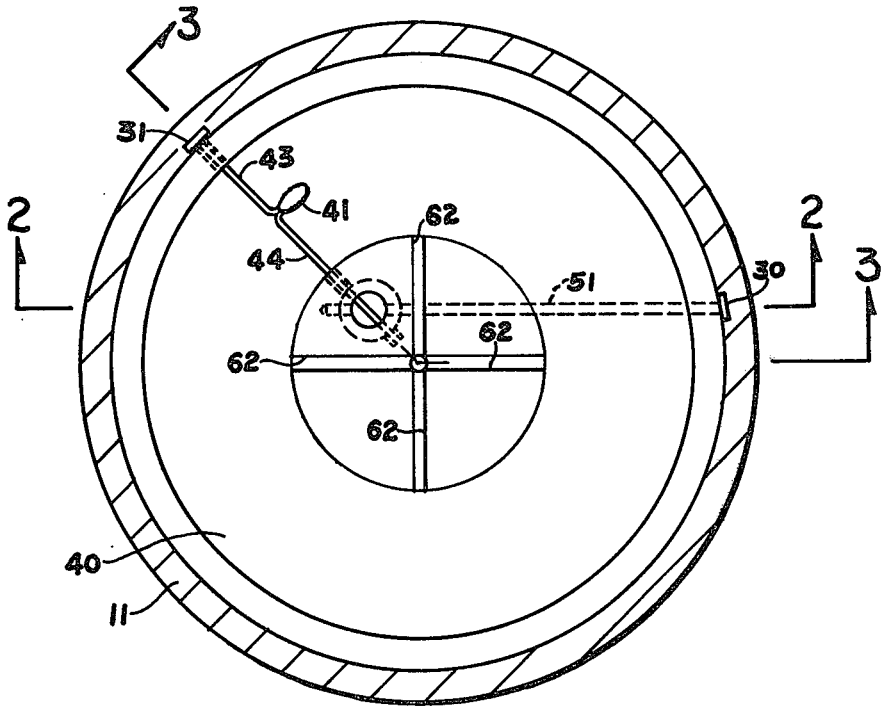
FIG. 1 is a sectional view of a gas generator embodying the principles of the invention, the view being taken at an elevation indicated substantially along line 1 — 1 of FIG. 2.
Figure 2:
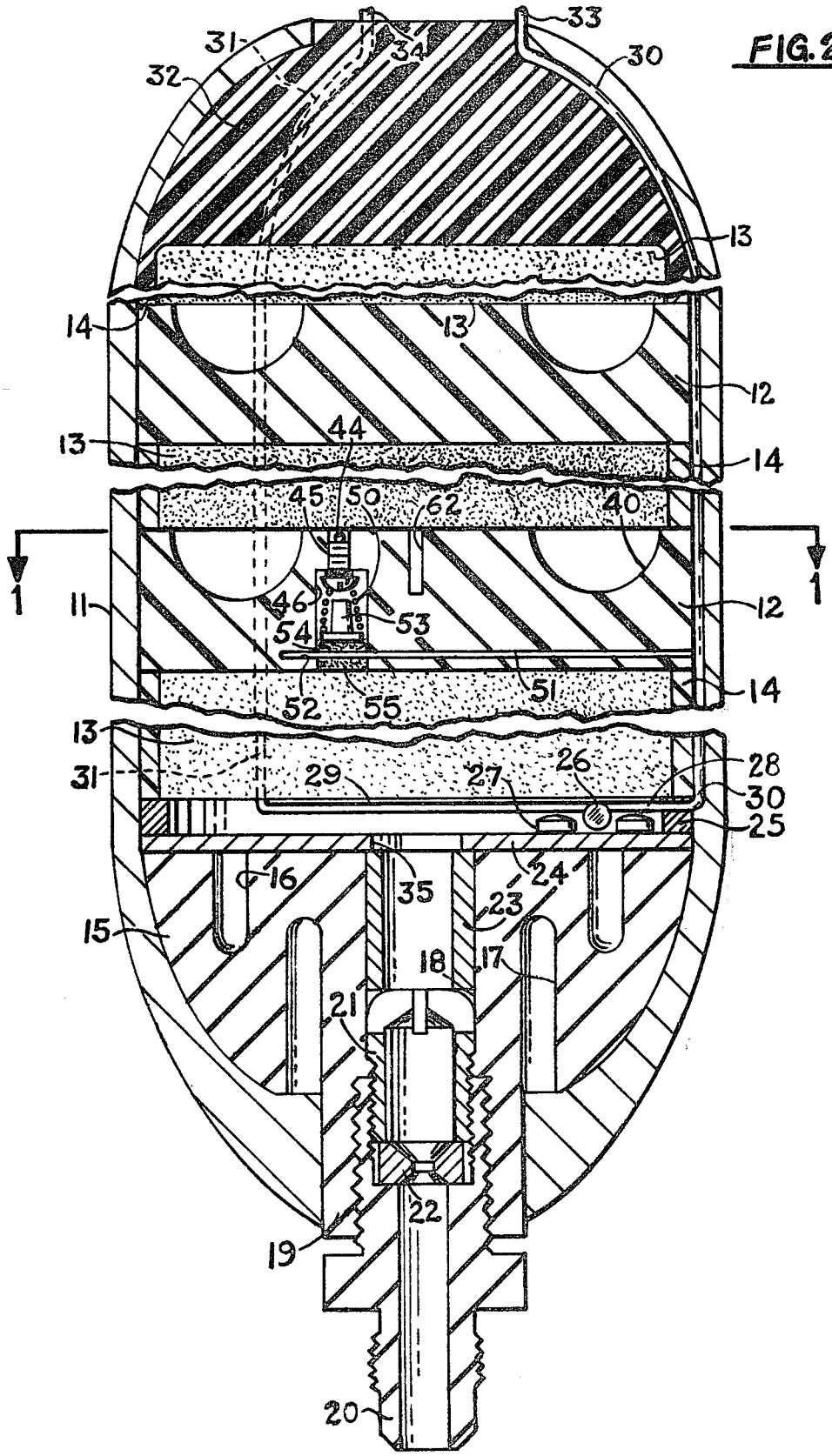
FIG. 2 is a sectional view taken along line 2 — 2 of FIG. 1.
Figure 3:
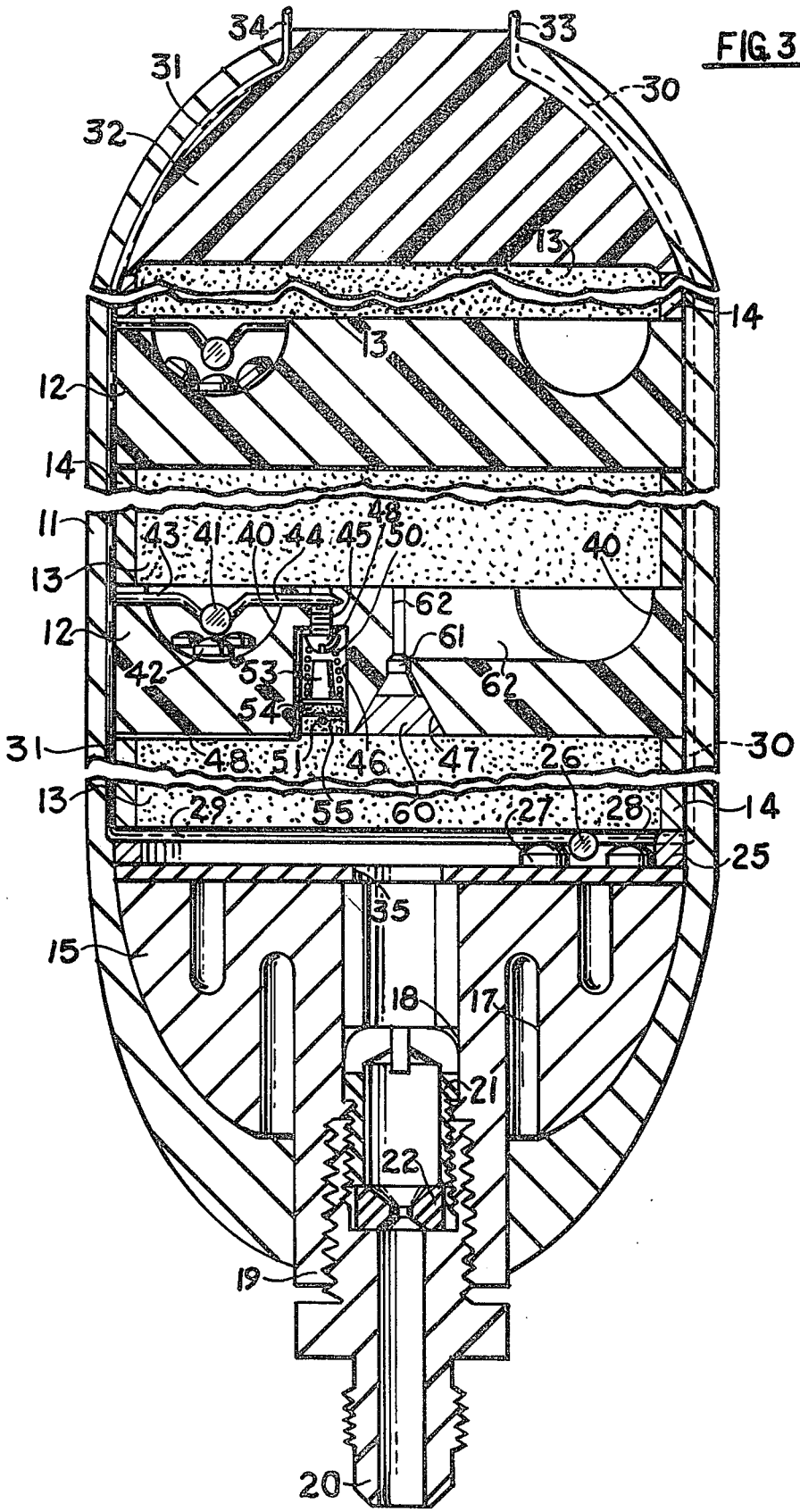
FIG. 3 is a sectional view taken along line 3 — 3 of FIG. 1.

The multi-stage gas generator, shown generally at 10 (FIG. 2), has a substantially cylindrical peripheral wall 11 (FIGS. 1, 2, 3), formed as a fiber glass filament winding with an epoxy binder, containing a plurality of individual gas generating compartments, tandemly arranged with each pair of adjacent compartments separated from each other by one of a group of phenolic partitioning walls 12 that are longitudinally spaced from each other. Each of the substantially cylindrical plate-like walls 12 extends laterally across the cylindrical wall 11 to which it is secured and a large cylindrical propellant disc 13, carrying an appropriate peripheral epoxy resin inhibitor 14, is mounted or otherwise secured in place on both sides of each wall 12. The specific construction of each of the similar or identical partitioning walls 12 will be hereinafter described.

The lightweight aluminum head member 15 (FIGS. 2, 3), containing annular recesses 16, 17, has a central passage 18 and an enlarged internally threaded forward annulus 19 for securement of a steel fitting 20 and its steel filter screw 21 that firmly secures a molybdenum orifice or throat member 22 and a phenolic insulation bushing 23 in their proper positions within passage 18. The forwardmost tubular portion of fitting 20 is externally threaded for appropriate connection to at least a partially deflated gas container (not shown) that may require replenishment of pressure gas.

Phenolic insulation disc 24 and ring 25 have external diameters substantially equal to that of the rearward face of head 15 to conveniently provide sufficient space within phenolic insulation ring 25 in the first compartment forward of the forwardmost propellant disc 13 to mount a first electric squib 26 in contact with its propellant charge 27 and electric wire means 28, 29 in electrical contact with squib 26 and extending in substantially opposite directions through predetermined apertures in ring 25 adjacent an electro-conductive epoxy bonded connection to respective forwardmost ends of copper wire shims 30, 31. Wire shims 30, 31 extend longitudinally along the predetermined portions or lateral surfaces of the successive propellant discs 13, partitioning walls 12, and phenolic rearward end cap 32, and terminate in corresponding free ends 33, 34 that are laterally spaced from each other. Peripheral filament winding 11, which is securely wrapped around the external surface portions of forward annulus 19, head member 15, rearward cap 32, and the various intermediate elements, firmly positions the laterally spaced shim ends or outlets 33, 34 in predetermined locations for selective connection with an appropriate electric pulse applying means (not shown) that will provide electric current across lead wires 33, 34 to thereby energize or complete a first electric circuit through electric wires 28, 29 and ignite squib 26, propellant charge 27, and the first or forwardmost propellant disc 13. Pressure gas thus generated will flow forwardly through the central aperture 35 of disc 24, bushing 23, filter screw 21, throat member 22 and fitting 20, for desired replenishment delivery.

The forwardmost partitioning wall 12 has in its rearward surface an annular recess 40, of substantially hemispherical base contour and containing a second electric squib 41 (FIG. 3) in contact with its propellant charge 42 and in electrical contact with electric wires 43, 44 that correspondingly extend through suitable laterally aligned apertures in the wall of recess 40 for a similar bonded connection to shim 31 and an electrical contact with the rearward end of shunt wire mounting screw 45. Electrically conductive screw 45, mounted in the base of a forwardly opening pyro-switch recess 46 provided in the forward face of the partitioning wall slightly offset from the centrally located conical recess 47, secures one end of shunt wire 48 behind the screw head and in electrical contact with wire 44. The other end of shunt wire 48 is likewise bonded to shim 31, with the shunt wire 48 extending (substantially parallel to or longitudinally aligned with wires 43, 44) along the forward surface of partitioning wall 12 and along a sidewall portion of pyro-switch recess 46, to preclude premature accidental ignition of squib 41 that otherwise might occur particularly if static electricity were present in the pyro-switch recess.

The pyro-electric switch positioned in recess 46 includes an electrically conductive brass spring 50 having one end in abutting contact with the head of screw 45 and preferably connected behind the screw head, and the forward end of spring 50 is aligned with the pyro-switch lead wire 51 that extends from its similarly bonded connection with shim 30 through a suitable lateral passage in the partitioning wall 12 (rearwardly adjacent its forwardmost surface), across the pyro-switch recess 46, and into an appropriate opening 52 (FIG. 2) in the sidewall of recess 46. Preferably, the forward end of spring 50 slidably receives the body portion of the headed brass pin member 53, the pin head being urged or biased forwardly (by partially compressed spring 50) toward the portion of the pyro-electric switch lead wire 51 extending across its path. An electrically non-conductive propellant body 54 (preferably a disc of polybutadine) is positioned rearwardly adjacent the lead wire 51 and forward of the brass pin head so as to initially preclude any closing of the pyro-switch. On assembly of the pyro-switch elements the remainder of recess 46 is filled with an electrically non-conductive putty-like propellant 55 (preferably polybutadine with a nitrocellulose binder).

A unidirectional gas plug 60 (FIG. 3) of frusto-conical configuration is seated and sealed with RTV rubber sealant in conical recess 47 to preclude propellant gas generated in the first compartment from entering gas plug chamber 61 which is in fluid communication with the rearwardly adjacent compartment and annular cavity or recess 40 via preferably 4 relatively thin and deep filtering slots 62 arranged at substantially 90° circumferentially spaced locations in the rearward surface of the partitioning wall 12.

Propellant pressure gas generated in the first or forward compartment will ignite and burn the propellant material 54, 55 in recess 46 to close the pyro-electric switch as the brass pin head is urged by spring 50 and contacts pyro-switch lead 51, at which time the safety shunt wire 48 will have melted sufficiently to thereby have been incapacitated. As a result, a parallel electric circuit (relative to the first electric circuit through wires 28, 29) through elements 43, 41, 44, 45, 50, 53 and 51 will have been readied for energization by selectively timed or continuous current or pulse re-application across lead wires 33, 34. Such energization will ignite the squib 41, its propellant charge 42, and the second compartment propellant disc 13, to generate additional propellant pressure gas that will exhaust through filtering slots 62, the then opened gas plug port 47, and the aforementioned various replenishment delivery elements. Additional identical partitioning wall constructions with sandwiched propellant discs may be arranged in tandem rearward of the second compartment propellant disc, enabling user selectively in the sequential delivery time and amounts of pressure gas replenishment.

Various modifications, changes or alterations may be resorted to without departing from the scope of the invention as defined in the appended claims.

I claim:

1. In a multi-stage gas generator having a plurality of individual gas generating compartments mounted in tandem and separated from each other by a phenolic partitioning wall, each of said compartments containing a propellant disc, a first one of said compartments at a forward end of said generator and containing a propellant charge, a first electric squib in contact with said propellant charge, and electric wire means in contact with said first squib and extending in substantially opposed directions, a pair of spaced apart electric lead wires respectively in contact with end portions of said electric wire means and extending longitudinally along substantially opposed sidewall portions of said generator to an outlet remote from said forward end for establishing an electric circuit through said first squib, each partitioning wall containing a filtering slot in fluid communication with a forward unidirectional gas plug, a propellant charge and an electric squib in contact therewith and in fluid communication with said filtering slot through an annular recess in a rearward surface of the corresponding partitioning wall, each propellant charge and electric squib positioned in the respective partitioning wall annular recess, and means including a pyro-electric switch having a burnable pyrotechnic responsive to propellant gas generated in an adjacent compartment for establishing an electric circuit through the corresponding partitioning wall squib and pyro-electric switch across said pair of lead wires and in parallel with the first squib electric circuit, so constructed and arranged that selective sequential initiation of said compartment propellant charges is available as a pulsing gas generator.

2. The structure in accordance with claim 1 wherein each partitioning wall includes means for shunting its corresponding pyro-electric switch to preclude accidental premature ignition of said partitioning wall squibs.

3. The structure according to claim 1 wherein each pyro-electric switch includes an electrically conductive spring having one end in electrical contact with one of said lead wires and another end aligned with an electric wire connected to the other of said lead wires, and an electrically non-conductive propellant body positioned forwardly of said corresponding spring and intermediate said aligned spring end and electric wire.

4. The structure of claim 3 wherein each spring and corresponding non-conductive propellant body are mounted in a forwardly opening partitioning wall recess and are embedded in an electrically non-conductive putty-like propellant, each putty-like propellant having a surface exposed to the corresponding adjacent compartment.

5. The structure of claim 4 wherein said one end of each spring is in abutment with the head of an electrically conductive screw mounted in the base of the corresponding partitioning wall recess and in electrical contact with said one lead wire.

* * * * *